US005541051A

United States Patent [19]

Verbeeck et al.

[11] Patent Number: 5,541,051

[45] Date of Patent: Jul. 30, 1996

[54] PREPARATION OF SILVER HALIDE TABULAR EMULSIONS IN THE PRESENCE OF POLAR APROTIC SOLVENTS AND/OR ALCOHOLS

[75] Inventors: Ann Verbeeck, Begijnendijk; Christiaan Van Roost, Aartselaar, both of Belgium; Angel Millan, Nijmegen, Netherlands

[73] Assignee: AGFA-Gevaert, N.V., Mortsel, Belgium

[21] Appl. No.: 374,177

[22] Filed: Jan. 18, 1995

[51] Int. Cl.[6] ..... G03C 1/015

[52] U.S. Cl. ..... 430/569; 430/567

[58] Field of Search ..... 430/569, 567

[56] References Cited

U.S. PATENT DOCUMENTS

| | | | |
|---|---|---|---|
| 3,871,887 | 3/1975 | Jones | 430/569 |
| 4,419,442 | 12/1983 | Falxa et al. | 430/569 |
| 4,725,534 | 2/1988 | Kagami et al. | 430/569 |
| 4,751,176 | 6/1988 | Pham | 430/569 |

*Primary Examiner*—Charles L. Bowers, Jr.
*Assistant Examiner*—Mark F. Huff
*Attorney, Agent, or Firm*—Breiner & Breiner

[57] ABSTRACT

This invention offers a new method to produce tabular silver halide grains, more preferably silver bromide or silver bromoiodide grains, having a tabularity, defined as the ratio between the aspect ratio and the thickness of the emulsion crystals, of at least 25 and a homogeniety of the distribution of said silver halide emulsion crystals, defined as a hundred times the ratio between the standard deviation and the average projective crystal diameter of said crystals of less than 30, characterized by the steps of adding to a reaction vessel containing at least one polar aprotic solvent a silver salt in an amount to get a concentration from 0.01 to 1M of said silver salt and a halide salt in an amount to get a concentration 1 to $10_4$ times the molar concentration of said silver salt; dissolving the said silver salt and the said halide salt; adding a protic solvent to the said reaction vessel in order to form twinned tabular nuclei; colloidally stabilizing said twinned tabular nuclei by the addition of a protective colloid apart or together with at least one protic solvent or with a mixture of at least one protic and at least one aprotic solvent, in order to obtain a ratio by weight of water to (a)protic solvent of not more than 40:60 in the reaction vessel; optionally growing said twinned tabular nuclei to tabular silver halide emulsion crystals in the same or in another reaction vessel by the addition of an aqueous soluble silver salt solution and a aqueous soluble halide salt solution; flocculating and decanting the said emulsion crystals obtained, followed by washing and redispersing or applying dialysis or ultrafiltration techniques.

7 Claims, 1 Drawing Sheet

PREPARATION OF SILVER HALIDE TABULAR EMULSIONS IN THE PRESENCE OF POLAR APROTIC SOLVENTS AND/OR ALCOHOLS

DESCRIPTION

1. Field of the Invention

The present invention relates to a preparation method of silver halide emulsions comprising tabular crystals.

2. Background of the Invention

The effects of various precipitation conditions on the formation of silver halide emulsions comprising tabular crystals have been studied extensively as the said tabular grains are known in the photographic art for quite some time. As early as 1961 Berry et al. described the preparation and growth of tabular silver bromoiodide grains in Photographic Science and Engineering, Vol 5, No 6. A discussion of tabular grains appeared in Duffin, Photographic Emulsion Chemistry, Focal Press, 1966, p. 66–72. Early patent literature includes U.S. Pat. Nos. 4,063,951; 4,067,739; 4,150,994; 4,184,877 and 4,184,878. However the tabular grains described herein cannot be regarded as showing a high diameter to thickness ratio, commonly termed aspect ratio. In a number of U.S. applications filed in 1981 and issued in 1984 tabular grains with high aspect ratio and their advantages in photographic applications are described as e.g. in U.S. Pat. Nos. 4,434,226; 4,439,520; 4,425,425; 4,425,426 and 4,433,048. A survey on high aspect ratio silver halide emulsions appeared in Research Disclosure, Vol 225, January 1983, Item 22534.

The above cited references on tabular grains are mainly concerned with high sensitive silver bromide or silver iodobromide emulsions.

In U.S. Pat. No. 4,713,320 the important role of the protective colloid used during the precipitation of emulsions comprising tabular silver bromoiodide grains has been disclosed: the presence in the reaction vessel of oxidized gelatin, containing less than 30 micromoles of methionine per gram is of crucial importance. The degree of oxidation of the protective colloid can be used in order to controll the tabularity of such grains. Otherwise it is generally known that the use of, e.g., phthalated gelatin as a protective colloid has a strong influence on the decrease of the percentage of the total projected area represented by said tabular grains.

From the patent literature and from our own experiments it can be concluded that the tabularity of tabular crystals, defined as the ratio between the aspect ratio and the thickness, is particularly controlled by the distance in the reaction vessel between the twin crystals during the nucleation step and by the pBr value during the growth step. A high tabularity within this concept requires a low pBr value, corresponding with an excess of bromide ions. As a consequence a strong physical ripening results in a heterogeneous size distribution.

Especially when a sensitometry with high-gradations is requested one way to reach this is to decrease the degree of heterogeneity of the tabular grain size distribution. Different attempts have been made as has been described in U.S. Pat. No. 4,801,522 by making use of the balanced double jet procedure and in U.S. Pat. No. 4,067,739 wherein accelerated flow double jet procedures with seed grains have been disclosed. Another method has been described in EP-A 421 740 wherein a high silver iodide content phase is present in the center of the grains and wherein the average aspect ratio remains less than 3. In U.S. Pat. No. 5,306,611 a preparation method has been described for twinned crystal monodispersed emulsions having an average aspect ratio of 5 or less. Another attempt has been described in EP-A 503 700, wherein lower aspect ratios are attained for the more monodisperse tabular grain population.

Higher aspect ratios in combination with small grain size distributions for silver halide tabular grains can be obtained by the use of an ingredient as disodium propyleneoxypolyoxyethylene disuccinate in the nucleation step as has been disclosed in U.S. Pat. No. 5,204,235. Another process of preparing a photographic emulsion containing tabular grains exhibiting a reduced degree of total grain dispersity has been given in U.S. Pat. Nos. 5,147,771; 5,147,772; 5,147,773; 5,171,659 and 5,252,453 wherein an alkylene oxide block copolymer surfactant is added during the parallel twin forming step.

Still another way consists in the use in the nucleation and/or subsequent steps of a water soluble polymer having nonionic groups other than low molecular weight gelatin as, e.g., derivatives of polyvinyl alcohol, polyvinyl pyrrolidone, polyvinyl imidazole, polyacrylamide or polymer having hydroxyquinolinethioether group as described in U.S. Pat. No. 5,215,879.

A preparation method wherein large tabular grains can be grown in less time and with narrower size distribution has been described in U.S. Pat. No. 5,318,888.

Further attempts to reach that goal have been disclosed in U.S. Pat. No. 5,250,403 and in JP-A 01 183 644 wherein the preparation of homogeneous grain nuclei is performed in a separate reaction vessel in aqueous medium, but whereafter an excess of bromide is required, with a pBr value of about 1.1, in order to get twinned nuclei in the said aqueous medium.

Especially when the pBr value is low the problem to get a monodispersed tabular grain distribution is aggravated. Further it is well-known that when the degree of homogeneity is high, the tabularity is low.

OBJECTS AND SUMMARY OF THE INVENTION.

It is an object of the present invention to find a new preparation method of silver halide photographic emulsions containing tabular silver halide grains showing a high aspect ratio, a high tabularity and a high degree of homogeneity. Other objects will become apparent from the description hereinafter.

A method has been found for the preparation of tabular silver halide emulsions having a tabularity, defined as the ratio between the aspect ratio and the thickness of the emulsion crystals, of at least 25 and a homogeniety of the distribution of said silver halide emulsion crystals, defined as a hundred times the ratio between the standard deviation and the average projective crystal diameter of said crystals of less than 30, characterized by the steps of adding to a reaction vessel containing at least one polar aprotic solvent a silver salt in an amount to get a concentration from 0.01 to 1M of said silver salt and a halide salt in an amount to get a concentration from 1 to 104 times, and more preferably from 1.5 to 10 times the molar concentration of said silver salt;

dissolving the said silver salt and the said halide salt;

adding a protic solvent, e.g., water, to the said reaction vessel in order to form twinned tabular nuclei;

stabilizing said twinned tabular nuclei by the addition of a protective colloid apart or together with at least one protic solvent or with a mixture of at least one protic and at least one aprotic solvent, in order to obtain a ratio by weight of water to (a)protic solvent of not more than 40:60 in the reaction vessel;

optionally growing said twinned tabular nuclei to tabular silver halide emulsion crystals by the addition of an aqueous soluble silver salt solution and a aqueous soluble halide salt solution;

flocculating and decanting the said emulsion crystals obtained, followed by washing and redispersing or applying dialysis or ultrafiltration techniques.

This invention thus offers a new way to produce tabular silver halide grains, more preferably silver bromide or silver bromoiodide grains, having a high tabularity, which is normally carried out under conditions of very high excess of the halide ion at pBr value lower than 2.0.

DETAILED DESCRIPTION OF THE INVENTION

Figure 1:
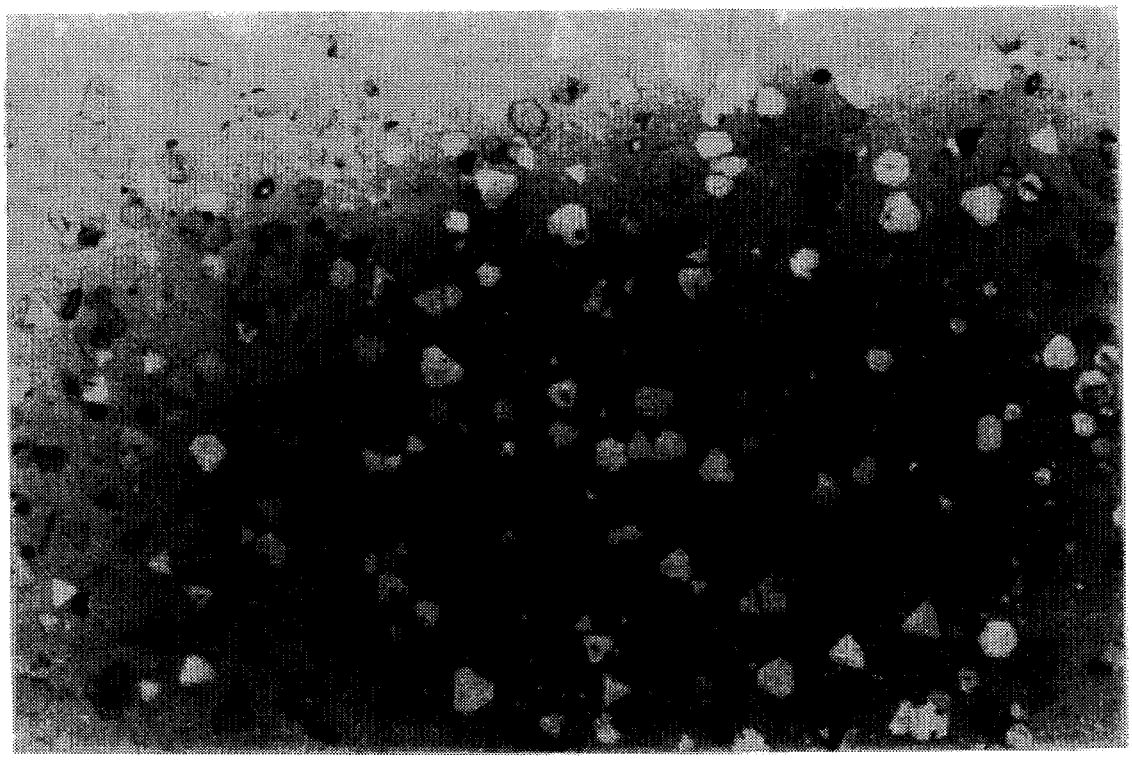

As there has nothing been found in patent literature about the preparation of tabular silver halide grains in solvents other than water, it has unexpectedly been found that the use of polar aprotic solvents is in favour to reach the objects of this invention.

The invention is compatible with one of the two most common techniques for introducing parallel twin planes into grain nuclei. The most well-known and most common of these techniques is to form the grain nuclei population that will be ultimately grown into tabular grains while concurrently introducing parallel twin planes in the same precipitation step, i.a., under conditions that are conducive to twinning.

As is well-known the production of tabular crystals by double jet methods in an aqueous (protic) medium is based on the presence of a very high excess of bromide ions in the bulk of the precipitating medium in one or more stages of the precipitation. Typically, the molar content of bromide ion in the bulk of the solution vessel is about seven orders higher than that of silver ion in the solution. Therefor a very important aspect of the present invention consists therein that tabular silver bromide or silver bromoiodide crystals are produced in a medium where the concentration of bromide ions in the bulk is only 1 to $10^4$ times, preferably 1.5 to 10 times higher than that of silver ions, i.e., a remarkably lower excess.

The second approach, which is in accordance with this invention, is to form a stable grain population and then adjust the pAg or pBr in the case of silver bromide or silver bromoiodide crystals of the "interim emulsion" or "seed emulsion" to a level conducive to twinning. Although there is no limitation concerning the composition and crystal size of the "seed emulsion" grains it is recommended to introduce the twin planes in the grain nuclei beforehand at an early stage of their "classical" precipitation. So it is contemplated to obtain a grain nuclei population parallel twin planes using less than 10 % and, more preferably, less than 2 % by weight of the total silver amount used to form the tabular grain emulsion. Although this can be accomplished using even less than 0.05 % by weight of the total silver to form parallel twin planes, it is usually convenient to use at least said amount of 0.05 % in order to form the twin plane containing grain nuclei population. The longer the introduction of parallel twin planes is delayed after forming a stable grain nuclei population the greater is the tendency towards increased grain dispersity.

The dissolution of silver and halide salts, preferably silver nitrate and at least one alkali halide salt, preferably an alkali metal bromide and/or iodide salt in polar aprotic solvents followed by the addition of protic solvents, preferably water, methanol or ethanol in order to provoke twinning, has two effects :

(1) an increase of the relative number of tabular crystals and (2) an increase of the size of the tabular populations without any relevant change in their thickness. Consequently the tabularity of the emulsion, defined as the ratio between the aspect ratio and thickness of the tabular grain is increased, as well as the degree of homogeneity for the whole emulsion.

The method to prepare tabular silver halide crystals according to this invention is based on the use of a starting medium in the reaction vessel of polar aprotic solvents, that do not contain any proton. Preferred polar aprotic solvents are acetone, acetonitrile (ACN), dimethylformamide (DMF) and dimethylsulfoxide (DMSO) and more preferably DMSO.

The precipitating medium is prepared by dissolving in the above mentioned solvents amounts of:

(a) one or several silver salts, like silver bromide, silver bromoiodide, silver chloride, silver chlorobromide, silver chlorobromoiodide, silver chloroiodide, silver iodide or silver nitrate, the said silver nitrate being most preferred, (b) a metal halide salt, wherein the said halide may be a single or a mixed halide salt, preferably an alkali metal bromide or bromoiodide salt and more preferably potassium bromide or a mixture of potassium bromide and potassium iodide.

More than one accompanying halide salt may be present in the precipitating media. Preferably the molar ratio of silver bromide and said accompanying halide salt is ranging in a molar ratio from 2:1 to 1:3 in polar aprotic solvents.

The concentration of silver in the reaction vessel containing at least one polar aprotic solvent previous to precipitation is 0.01 mole to 1 mole per liter. The total concentration of halide previous to precipitation is from 1 to 104 times, preferably from 1.5 to 4 times that of silver ion, and still more preferably 1.6 to 3 times that of the silver ion concentration.

By the addition in the further step of a protic solvent the formation of twinned silver nuclei starts. In order to stabilize the precipitated silver halide grain nuclei addition of a protective colloid apart or together with at least one protic solvent or with a mixture of at least one protic and at least one aprotic solvent is required. Preferred protic solvents are water and (lower) alcohols as, e.g., methanol and ethanol.

In a preferred embodiment according to this invention gelatin and/or silica are added as protective colloid(s).

Conventional lime-treated or acid treated gelatin as described in e g "The Science and Technology of Gelatin" edited by A. G. Ward and A. Courts, Academic Press 1977, page 295 and next pages, can be used but is not required as long as no protic solvents are present in the reaction vessel. The same can be said for silica sol as a protective colloid. Silica is recommended as a protective colloid in the preparation of silver halide tabular grains as it has a favourable effect upon pressure sensitivity.

According to this invention the ratio by weight of water to (a)protic solvent should not be more than 40:60 in the reaction vessel. In a preferred embodiment the dispersion medium contains 5 to 60 % by weight of polar aprotic solvents.

The precipitated silver halide grain nuclei can be separated by decantation and/or (ultra) filtration, washed and stored for further use. An advantage thereof is that, due to the use in the preparation step of a lower excess of halide salts, less water can be used in the washing process.

As has been set forth above, according to this invention bromide ions are preferably present in each stage of the precipitation, other halides can also be added to the dispersing medium as, e.g., chloride and/or iodide ions. In order to prepare silver bromoiodide, silver chlorobromide or silver chlorobromoiodiode tabular crystals, the said chloride and/or iodide ions can be added. It is specifically contemplated that in the precipitation of silver bromoiodide emulsions up to 10 mole percent, and more preferably up to 3 mole percent of iodide ions can be incorporated in the silver halide. Iodide ions can be provided not only by adding inorganic iodide salts but also by adding organic compounds releasing iodide ions as has, e.g., been described in EP-Applications 561 415, 563 701 and 563 708.

Although the crystal size of the so called "seed crystals" if added in that form to the reaction vessel containing polar aprotic solvents is not critical, as their solubility in said aprotic solvents is high, it is recommended to add fine silver halide crystals to the reaction vessel: crystal sizes smaller than 0.3 μm, more preferably smaller than 0.1 μm and still more preferably smaller than 0.05 μm, the so-called "Lippmann emulsions".

The step of precipitation, caused by the addition of protic solvents as, e.g., water and/or alcohols, can be performed by a portionwise addition thereof. An addition of the said solvents with a varying flow rate is possible. If the addition of the said solvents is performed in different steps, the said steps can be alternated by physical ripening steps and/or by so called "neutralization steps", during which the silver concentration is changed to a required or preferred value by adding an amount of silver nitrate solution or a halide salt solution, whether or not in aprotic or protic medium, within a well-defined time of addition by means of the single-jet technique. Alternative ways to regulate the pAg to the desired value before continuing the processing are, e.g., dilution of the emulsion present in the reaction vessel, evaporation of the more volatile solvents, a change in the temperature of the reaction vessel, diafiltration or ultrafiltration.

During the optionally present growth step(s) following further in partially protic solvent mixtures in the same or in a reaction vessel different from the one in which twinned nuclei were initiated before, an increasing flow rate of aqueous silver nitrate and aqueous alkali metal halide solutions is preferably applied, e.g., a linearly increasing flow rate. Typically the flow rate at the end is about 3 to 10 times greater then at the start of the growth step. For the succesful preparation of tabular grains according to the present invention the pBr before the start and during the different stages of the precipitation is maintained at a well-defined value, preferably higher than 2.0.

The photographic emulsions comprising silver halide tabular crystals, according to the present invention, may have a homogeneous or a heterogeneous halide distribution within the crystal volume. A heterogeneous halide distribution may be obtained by application of growth steps having a different halide composition or by conversion steps, e.g., by addition of halide ions that provide less soluble silver salts, onto existing tabular cores. In the case of a heterogenous distribution of halide ions a multilayered grain structure is obtained. Obviously the tabular form has to be maintained in this case, in order to get tabular emulsion crystals in accordance with this invention.

In accordance with this invention wherein polar aprotic solvents are used in the presence of protic solvents, being water and/or alcohols, the homogeneity of the distribution of the tabular silver halide emulsion crystals obtained is low, especially with relation to the relatively low excess of halide ions used during the different preparation steps in comparison with the excessive amounts used in common precipitation techniques for tabular silver halide grains in aqueous medium. Said "homogeneity" defined as hundred times the ratio between the standard deviation and the average projective crystal diameter of said crystals, is less than about 30, and more preferably less than 20. The said homogeneity can further advantagously influenced by the presence of an alkylene oxide block copolymer surfactant or polyoxyalkylenes, in the solvent(s) present in the reaction vessel.

Further techniques preferred to concentrate the emulsion crystals in the reaction vessel are dialysis and ultrafiltration or flocculation and washing procedures, followed by redispersion and addition of the required amounts of colloid binder such as gelatin, silica, polyvinylpyrrolidone, etc.

Any combination or any choice of the mentioned techniques may be applied thereto.

The obtained tabular silver halide crystals can have an average thickness of at least 0.05 μm. A preferred average thickness however is between 0.10–0.30 μm and more preferably between 0.20 and 0.30 μm. Further the average aspect ratio is at least 2:1, preferably more than 5:1, and even more preferably more than 8:1, in order to obtain a tabularity of at least 50, up to even 150.

Irrespective of the fact whether gelatin or silica or a combination of both is used as a protective colloid tabular silver halide emulsions in connection with the present invention can further be chemically sensitized as described e.g. in "Chimie et Physique Photographique" by P. Glafkides, in "Photographic Emulsion Chemistry" by G. F. Duffin, in "Making and Coating Photographic Emulsion" by V. L. Zelikman et al, and in "Die Grundlagen der Photographischen Prozesse mit Silberhalogeniden" edited by H. Frieser and published by Akademische Verlagsgesellschaft (1968). As described in said literature chemical sensitization can be carried out by effecting the ripening in the presence of small amounts of compounds containing sulphur, selenium or tellurium, e.g., thiosulphate, thiocyanate, thioureas or the corresponding selenium and/or tellurium compounds, sulphites, mercapto compounds, and rhodamines. The emulsions may be sensitized also by means of gold-sulphur, gold-selenium or gold-tellurium ripeners or by means of reductors e.g. tin compounds as described in GB Patent 789,823, amines, hydrazine derivatives, formamidine-sulphinic acids, and silane compounds.

The tabular silver halide emulsions may be spectrally sensitized with methine dyes such as those described by F. M. Hamer in "The Cyanine Dyes and Related Compounds", 1964, John Wiley & Sons. Dyes that can,be used for the purpose of spectral sensitization include cyanine dyes, merocyanine dyes, complex cyanine dyes, complex merocyanine dyes, hemicyanine dyes, styryl dyes and hemioxonol dyes. Particularly valuable dyes are those belonging to the cyanine dyes, merocyanine dyes and complex merocyanine dyes. A survey of useful chemical classes of spectral sensitizing dyes and specific useful examples in connection with tabular grains is given in Research Disclosure Item 22534.

In classical emulsion preparation spectral sensitization traditionally follows the completion of chemical sensitization. However, in connection with tabular grains, it is specifically considered that spectral sensitization may occur simultaneously with or may even precede completely the chemical sensitization step: the chemical sensitization after spectral sensitization is believed to occur at one or more ordered discrete sites of tabular grains.

Additional gelatin may be added in any further preparation step before coating in order to establish optimal coating conditions and/or to establish the required thickness of the coated emulsion layer. Preferably a gelatin to silver halide ratio ranging from 0.3 to 1.0 is then obtained.

In a further stage after the end of the precipitation and desalting step of the silver halide emulsion, followed by chemically ripening, whether or not in the presence of spectral sensitiser(s) an emulsion is obtained that can be prepared for coating in light-sensitive photographic layers of silver halide photographic materials after the addition of the well-known ingredients, as, e.g. stabilisers, surface-active agents, hardening agents, antistatic agents, filter dyes, development accelerators, compounds improving the dimensional stability of the photographic element, UV-absorbers, spacing agents and plasticizers, etc., as has been summarised in Research Disclosure 36554, September 1994, p. 501–541.

Two or more types of tabular silver halide emulsions that have a different halide composition and/or that have been prepared differently can be mixed for forming a photographic emulsion for use in various photographic elements.

The photographic tabular grains in connection with the present invention can be used in various types of photographic elements, e.g. black and white silver halide photographic materials, like materials used for X-ray diagnostic purposes, materials for micrography, duplicating materials, colour sensitive materials, etc., and can be coated on suitable supports in the required layer arrangements adapted to each application.

The following example illustrates the invention without however limiting it thereto.

EXAMPLE

Preparation of the inventive emulsion. This example illustrates the effect of polar aprotic solvents in the precipitation at a pBr critical for tabular grains production.

Preparation of the stock solution A. A stock solution (A) was prepared by dissolving 8.54 g of silver nitrate and 11.95 g of potassium bromide in 25 ml of DMSO. A solution B was prepared by mixing 1 ml of water with 4 ml of DMSO. 1 ml of stock solution A was diluted in 9 ml of DMSO and then solution B was added dropwise with stirring until a precipitate was formed. A SEM picture of the precipitated emulsion can be seen in FIG. 1 (magnification factor: 200). Ultramicrotoms of those crystals observed by TEM, revealed the presence of multiple twin planes in the majority of the crystals.

During the following physical ripening stage of 20 minutes the temperature was raised to 70° C. and 16 ml of water containing 1.6 g of gelatin were added.

Then, crystal growth was performed by introducing by a double jet during 4 min an aqueous solution of silver nitrate containing 0.32 mole per liter at a constant flow rate of 1.5 ml/min and an aqueous solution of potassium bromide of the same molarity in order to maintain a constant silver potential measured by a silver electrode versus a silver/silver chloride reference electrode of +18 mV.

A second growth step was performed by introducing by a double jet during 76 min the said aqueous solution of silver nitrate starting at a flow rate of 1.5 ml/min and linearly increasing the flow rate to an end value of 7.5 ml/min and the said solution of potassium bromide at an increasing flow rate in order to maintain a constant potential of +18 mV.

Finally the emulsion was concentrated and washed by an ultrafiltration technique.

As a consequence we can summarise that by the preparation method according to this invention described hereinbefore a breakthrough in the preparation of tabular silver halide grains in non-aqueous medium has been realised.

We claim:

1. Method of preparing tabular silver halide emulsions, wherein crystals in said emulsion have a tabularity, defined as a ratio between aspect ratio and thickness, of at least 25 and homogeneity of said emulsion crystal, defined as a hundred times the ratio between standard deviation and average projective crystal diameter of said crystals of less than 30, characterized by the steps of adding to a reaction vessel containing at least one polar aprotic solvent a silver salt in an amount to get a concentration from 0.01 to 1M of said silver salt and a halide salt in an amount to get a concentration 1 to $10^4$ times the molar concentration of said silver salt, said polar aprotic solvent being at least one member selected from the group consisting of acetone, dimethylformamide, dimethylsulfoxide and acetonitrile;

dissolving the said silver salt and the said halide salt;

adding a protic solvent to the said reaction vessel in order to form twinned tabular nuclei, said protic solvent being a member of the group consisting of water, methanol or ethanol;

colloidally stabilizing said twinned tabular nuclei by the addition of a protective colloid apart or together with at least one protic solvent or with a mixture of at least one protic and at least one aprotic solvent, in order to obtain a ratio by weight of water to (a)protic solvent of not more than 40:60 in the reaction vessel;

optionally growing said twinned tabular nuclei to tabular silver halide emulsion crystals in the same or in another reaction vessel by the addition of an aqueous soluble silver salt solution and a aqueous soluble halide salt solution;

flocculating and decanting the said emulsion crystals obtained, followed by washing and redispensing or applying dialysis or ultrafiltration techniques.

2. Method according to claim 1, wherein said silver salt is silver nitrate and wherein the said halide salt is present in an amount to get a concentration of 1.5 to 10 times the molar concentration of said silver salt.

3. Method according to claim 1, wherein said silver salt is silver nitrate and wherein said halide salt is an alkali metal bromide or a mixture of an alkali metal bromide and an alkali metal iodide.

4. Method according to claim 1, wherein the concentration of silver halide salt prior to precipitation is between 0.01 and 1 mole per litre.

5. Method according to claim 1, wherein the concentration of halide salts prior to precipitation is from 1.5to 4 times higher than the concentration of silver halide salt, expressed as the equivalent amount of silver nitrate.

6. Method according to claim 1, wherein, after precipitation, a dispersion medium is obtained containing 5 to 60% of polar aprotic solvents.

7. Method according to claim 1, wherein said protective colloid is gelatin and/or silica.

* * * * *